US009877596B2

(12) United States Patent
Schaarschmidt

(10) Patent No.: US 9,877,596 B2
(45) Date of Patent: Jan. 30, 2018

(54) SMALL CHILD AND BABY CARRIER

(71) Applicant: Lewon Schaarschmidt, Midlevels (HK)

(72) Inventor: Lewon Schaarschmidt, Midlevels (HK)

( * ) Notice: Subject to any disclaimer, the term of this patent is extended or adjusted under 35 U.S.C. 154(b) by 124 days.

(21) Appl. No.: 14/459,833

(22) Filed: Aug. 14, 2014

(65) Prior Publication Data

US 2015/0272342 A1 Oct. 1, 2015

(30) Foreign Application Priority Data

Mar. 28, 2014 (DE) ..... 20 2014 002 721

(51) Int. Cl.
*A61G 5/00* (2006.01)
*A61G 1/00* (2006.01)
*A47D 13/02* (2006.01)

(52) U.S. Cl.
CPC ..... *A47D 13/025* (2013.01)

(58) Field of Classification Search
CPC .. A47D 13/025; A47D 13/02; A45F 2003/045
USPC ..... 224/158, 159, 160
See application file for complete search history.

(56) References Cited

U.S. PATENT DOCUMENTS 5,205,450 A 4/1993 Derosier
7,766,199 B1 * 8/2010 Caperon ..... A47D 13/025 224/158
8,636,181 B2 1/2014 Gunter et al.
8,752,739 B2 * 6/2014 Bergkvist ..... A47D 13/025 224/158
9,185,993 B2 * 11/2015 Telford ..... A47D 13/025
2010/0147910 A1 6/2010 Schachtner
2010/0308088 A1 * 12/2010 Lindblom ..... A47D 13/025 224/160
2012/0298702 A1 * 11/2012 Jung ..... A47D 13/025 224/158

FOREIGN PATENT DOCUMENTS

DE 20 2007 006 204 U1 10/2008
DE 202008013895 U1 2/2009
DE 20 2008 012 126 U1 3/2009
(Continued)

OTHER PUBLICATIONS

Extended European Search Report dated (No. 14002401.9) Feb. 27, 2015.

(Continued)

*Primary Examiner* — Derek Battisti
(74) *Attorney, Agent, or Firm* — Rabin & Berdo, P.C.

(57) ABSTRACT

A baby and small child carrier, includes a waist strap and a carry bag that extends from a lower end to an upper end. At least during the use of the baby and small child carrier a main section of the lower end of the carry bag is connected to the waist strap, so that during a first use state, a first connecting width is obtained between the carry bag and the waist strap. At least one additional element, or at least one additional section of the carry bag, or at least one additional section of the waist strap is provided, so that the carry bag can be connected adjacent to the lower end of the main section to the waist strap, so that for a second use state a wider, second connecting width is obtained between the carry bag and the waist strap, compared to the first connecting width.

9 Claims, 8 Drawing Sheets

(56) References Cited

FOREIGN PATENT DOCUMENTS

Figure 1:
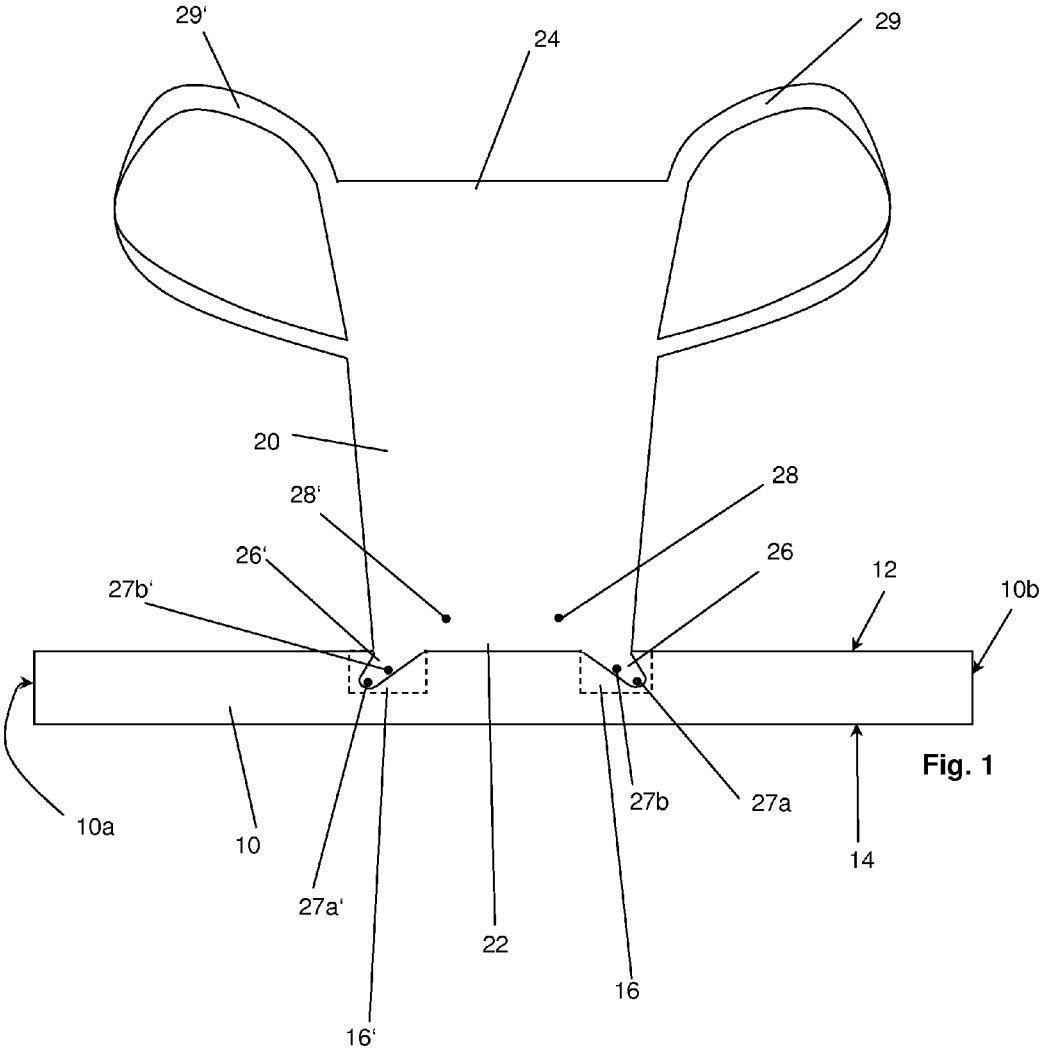

| | | | |
|---|---|---|---|
| DE | 202008015976 | U1 | 3/2009 |
| DE | 202011103052 | U1 | 8/2011 |
| DE | 11 2010 003 056 | T5 | 9/2012 |
| DE | 20 2012 104 318 | U1 | 3/2013 |
| DE | 20 2014 100 616 | U1 | 6/2014 |
| EP | 2 491 825 | A2 | 8/2012 |
| JP | 3114676 | U1 | 10/2005 |
| JP | 2012-187352 | A | 10/2012 |
| KR | 10-2009-0131101 | A | 12/2009 |
| KR | 20-2009-0012560 | U | 12/2009 |
| KR | 20-2010-0002191 | U | 3/2010 |
| WO | WO 2009/034233 | A1 | 3/2009 |
| WO | WO 2013-037514 | A1 | 3/2013 |

OTHER PUBLICATIONS

Extended European Search Report dated (No. 14002399.5) Mar. 18, 2015.
Extended European Search Report dated (No. 14002400.1) Mar. 18, 2015.

* cited by examiner

SMALL CHILD AND BABY CARRIER

The invention relates to a baby and small child carrier, as defined in the preamble to claim 1.

Generic baby and small child carriers have long been known and have been available in various designs. A baby and small child carrier of this type always consists of a waist strap, a carry bag that extends from a lower end to an upper end, wherein the lower end is generally connected permanently to the waist strap, for example by sewing it on. The baby and small child carrier furthermore comprises at least two shoulder straps, respectively extending from the upper end of the carry bag. The lower ends of the shoulder straps are generally connected to a center section of the carry bag, but can in principle also be connected to the waist strap. The two ends of the waist strap can be connected via a clasp or the like. When in use, the waist strap extends around the hip of the carrying person while the baby or small child sits inside the bag with the legs sticking out on the right and left side out of the bag.

Insofar as no further measures have been taken, the problem occurs that a baby and small child carrier is only suitable for use during a relatively small size interval of the baby or small child. To overcome this problem, baby and small child carriers have been proposed in the past which make it possible to extend the carry bag in upward direction with the aid of removable elements, so-to-speak to allow the baby and/or small child to "grow along."

However, it was found that extending the carry bag in upward direction only partially solves the problem since the "seat width" does not grow along with an extension of the carry bag. It was found that the seat width should also be adjusted for the baby and/or small child to allow a comfortable seat and to avoid incorrect seating for the baby and/or small child.

According to the invention, a baby and small child carrier is thus made available for which the seat width can also be adjusted to the size of the baby and/or small child.

As a rule, the seat width is defined by the connection width between the lower end of the carry bag and the waist strap. According to the invention, the option for adjusting this connection width is provided in that for a first use state, a main section of the lower end of the carry bag is connected to the waist strap (in most cases permanently, for example through sewing, as is the case according to the prior art or also because the carry bag and the waist strap are embodied at least in part integrally) and in that at least one additional element, or at least one additional section of the carry bag, or at least one additional section of the waist strap is provided, by means of which the carry bag can be connected to the waist strap adjacent to the main section of its lower end. An increased connection width is thus obtained between the carry bag and the waist strap for the second use state, as compared to the first connection width.

As a rule, the baby and small child carrier is advantageously embodied symmetrical, so that two such elements and/or sections are provided which extend during the second use state on the left and on the right side of the main section of the lower end of the carry bag, between the carry bag and the waist strap. In principle, asymmetrical designs would also be conceivable, but are not preferred as a rule, so that in the following we always refer to the aforementioned symmetrical solution with two additional elements or two additional sections.

Insofar as two additional elements are provided, these should always be arranged detachably on the carry bag and detachably on the waist strap. If additional sections of the carry bag are provided, these are preferably embodied in the shape of wings that are permanently attached to or integrally formed with the carry bag and which can furthermore be connected detachably to the waist strap. For this, each wing must be provided with at least one fastening element and the waist strap must be provided with the matching counter fastening element.

In the reverse case, when additional sections of the waist strap are provided, these are permanently connected to the waist strap and are provided with at least one fastening element, wherein the carry bag must be provided with the corresponding counter fastening elements.

All types of fastening elements and counter fastening elements can be used for these fastening and counter fastening elements, in particular snap pairs, Velcro element pairs, hook and eyelet fasteners, buttons and button holes and zippers. Several types of fastening elements and counter fastening elements can also be used parallel to each other, for example snap pairs and Velcro fastener pairs, wherein this applies to all three options mentioned.

The carry bag of the currently preferred embodiment (first embodiment) is respectively provided with an additional section in the form of a wing, adjacent to the main section of its lower end, wherein it is furthermore advantageous if these wings in the second use state are at least partially stored accommodated inside pockets in the waist strap which contain the counter elements.

For this embodiment, it is furthermore advantageous that the carry bag is provided with an additional counter fastening element for each wing, so that the wing can occupy at least one defined position, relative to the carry bag, when it is not connected to the waist strap. It is furthermore advantageous in that case to provide several fastening elements for each wing and/or several counter fastening elements for each wing, so that the wings can be brought into at least two (or more) defined positions, relative to the carry bag, thus resulting in a further option for precisely adjusting the sitting position.

Additional advantageous embodiments of the invention follow from the dependent claims and the exemplary embodiment, explained further with reference to the Figures.

Figure 2:
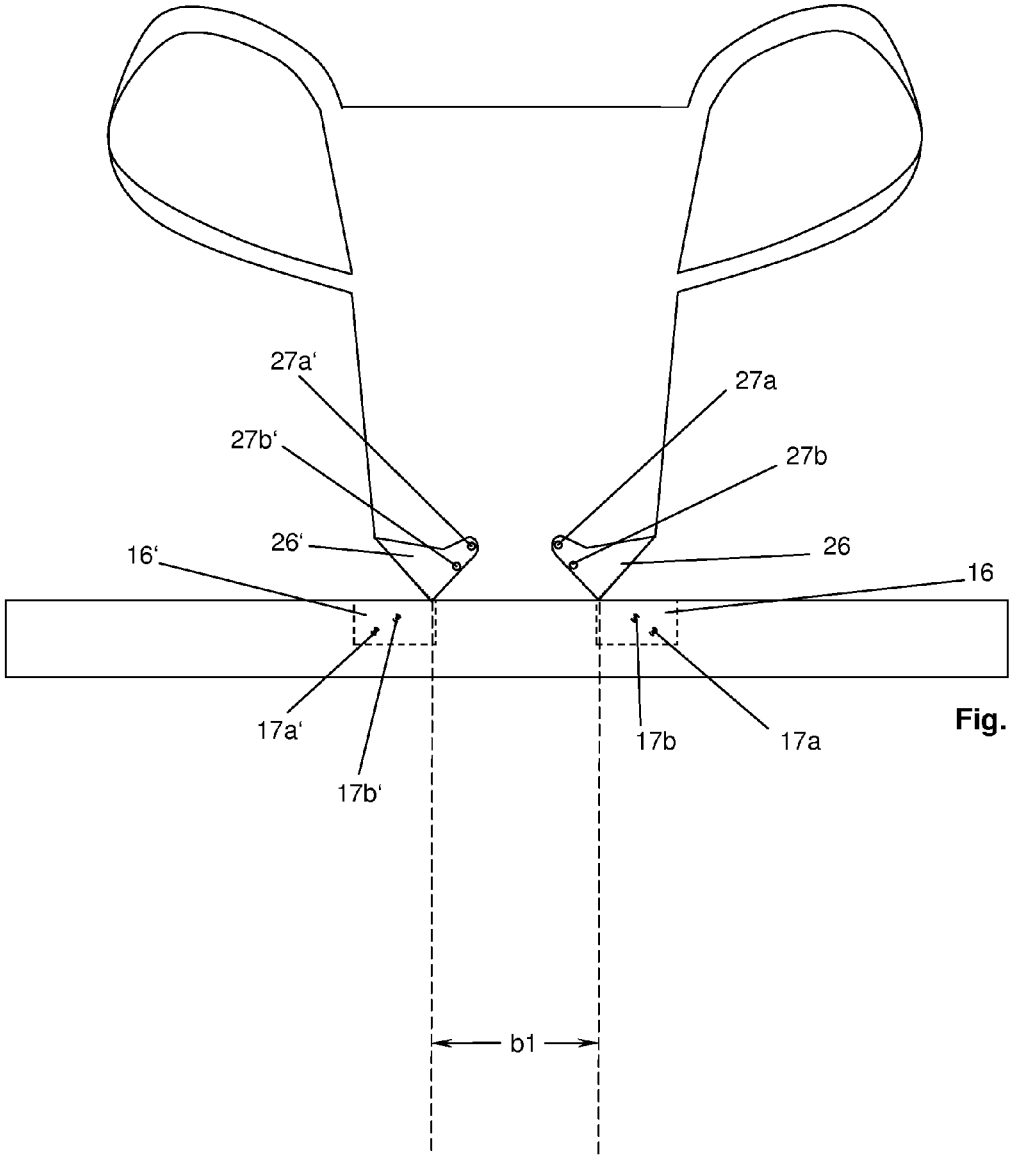
Figure 3:
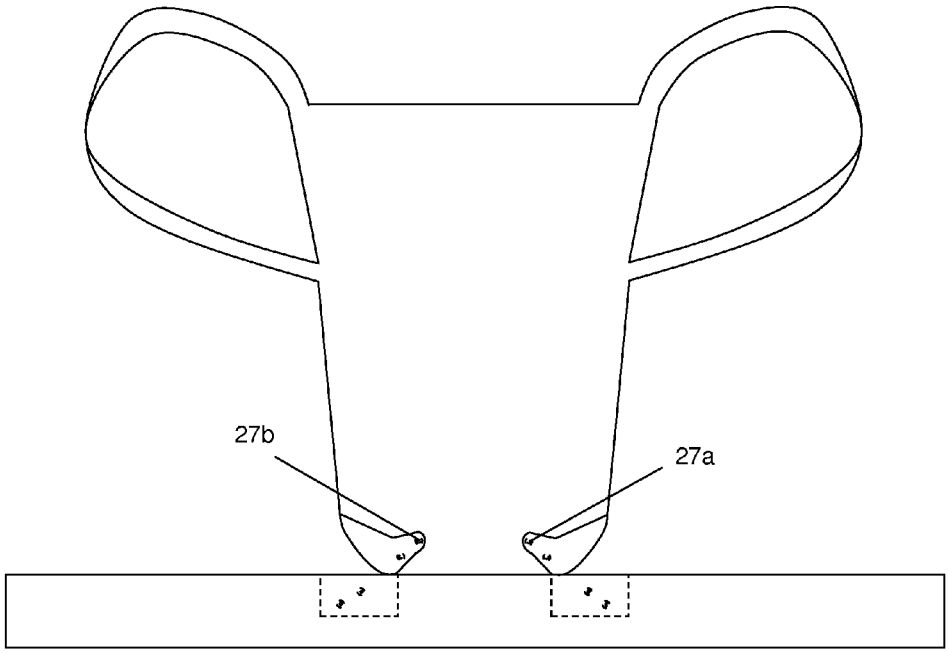
Figure 4:
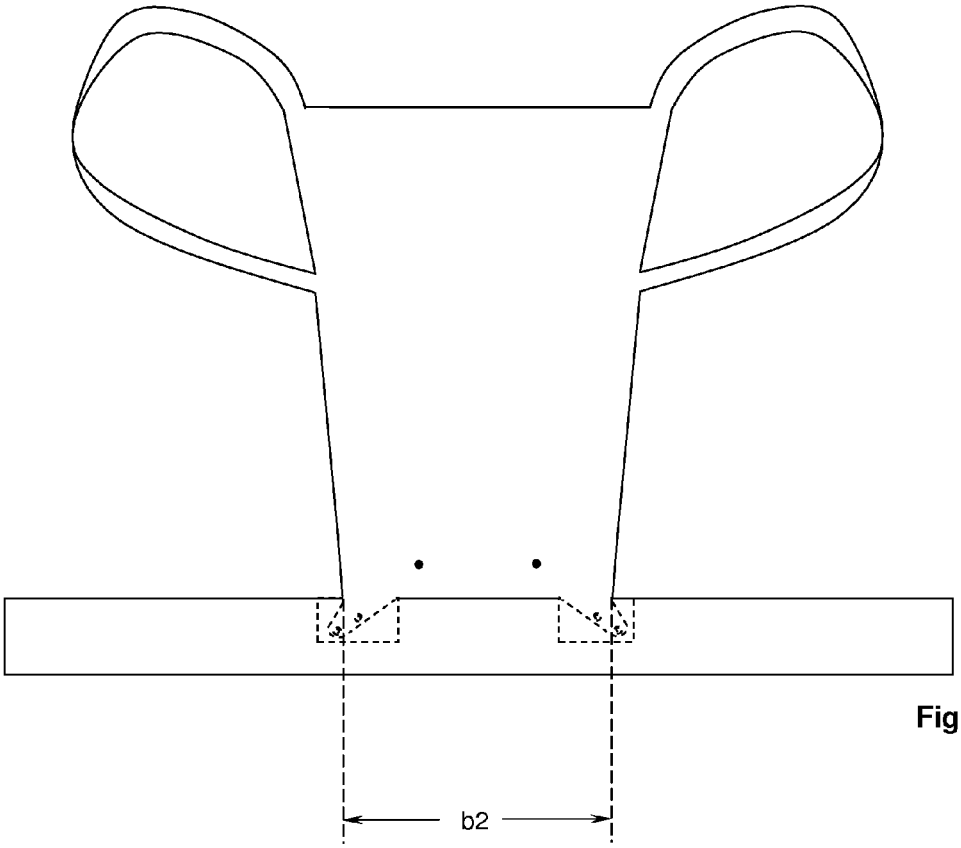
Figure 5:
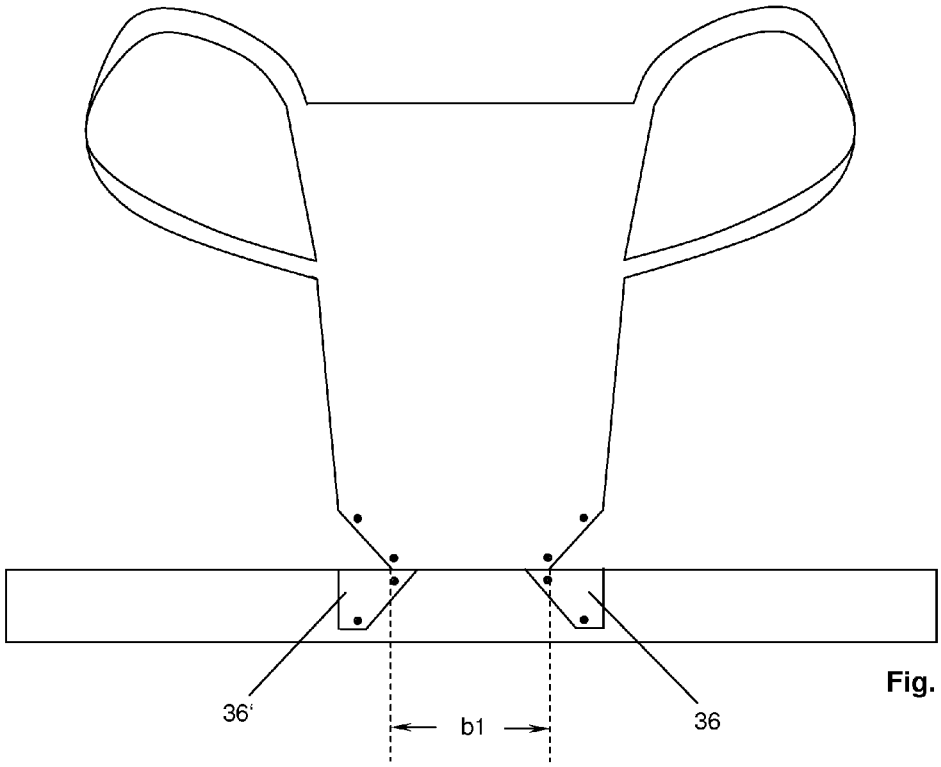
Figure 6:
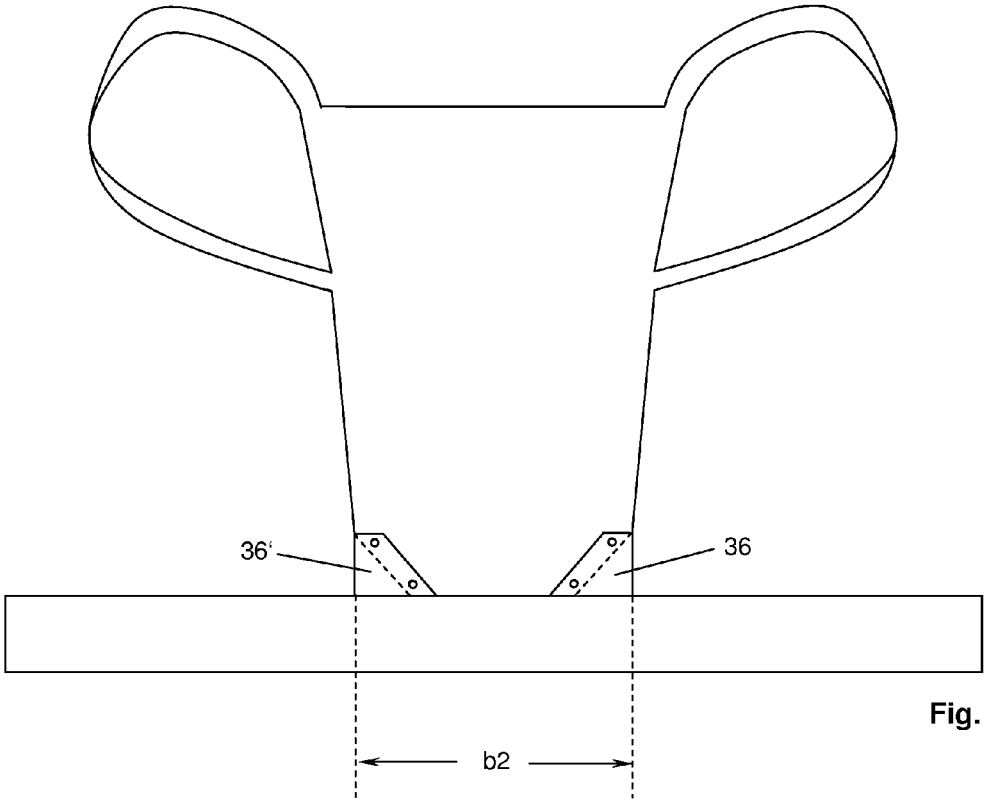
Figure 7:
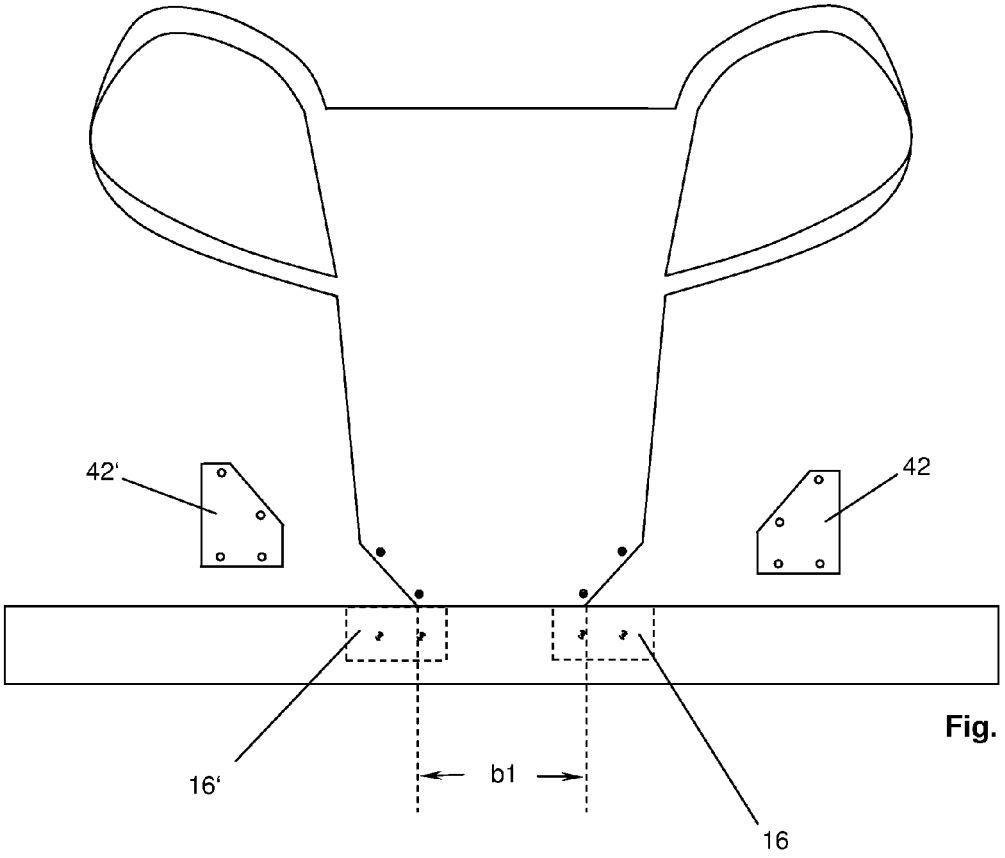
Figure 8:
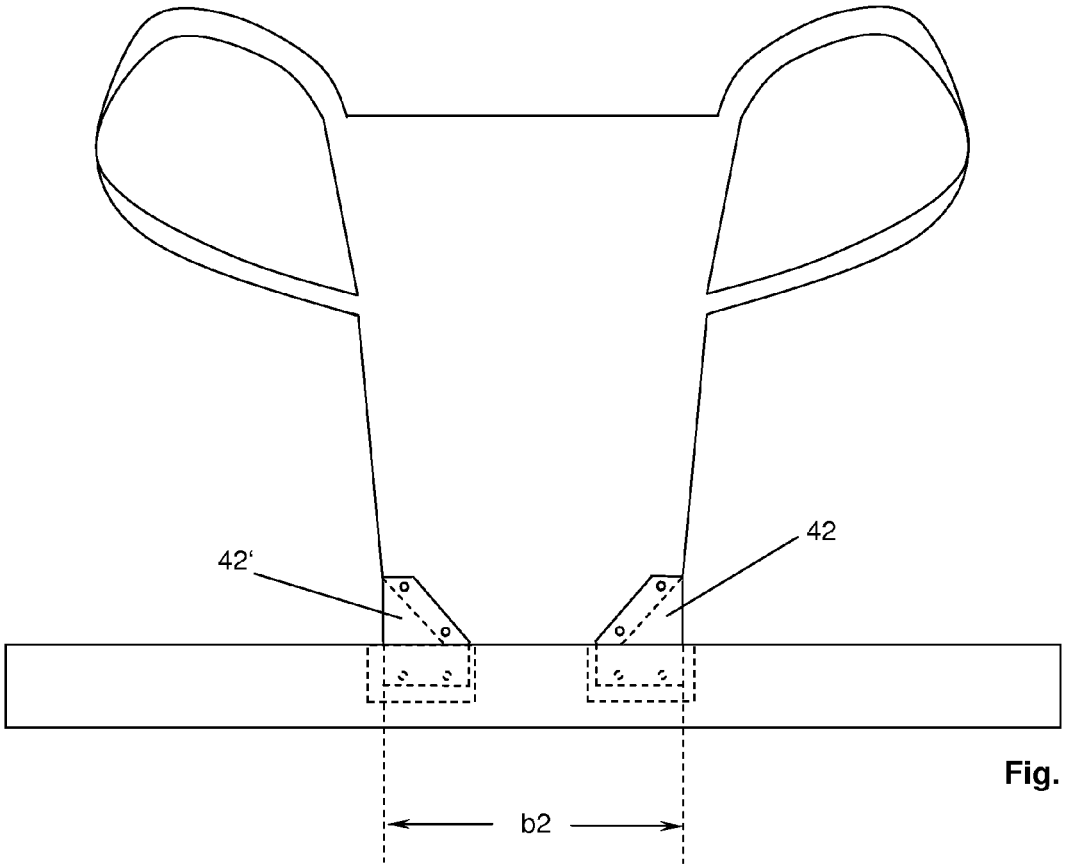

The invention is explained with the aid of exemplary embodiments and with reference to the Figures, showing in:

FIG. 1 A schematic view from above of a baby and small child carrier, spread out flat;

FIG. 2 The view shown in FIG. 1, in a first use state;

FIG. 3 The view shown in FIG. 2, but with a different adjustment for the first use state;

FIG. 4 The view shown in FIGS. 2 and 3, showing a second use state;

FIG. 5 A second embodiment of the invention, showing a first use state that corresponds to FIG. 2;

FIG. 6 The view shown in FIG. 5, in the second use state;

FIG. 7 A third embodiment of the invention in a use state that corresponds to the first use state shown in FIG. 2;

FIG. 8 The view shown in FIG. 7, in the second use state.

With reference to FIGS. 1 to 4, we first describe an example of the first embodiment. Initially, all components of the baby and small child carrier are explained with reference to FIGS. 1 and 2.

The baby and small child carrier comprises a waist strap 10 that extends from a first end 10*a* to a second end 10*b*. The two ends 10*a*, 10*b* as a rule are provided with coupling elements, such as are widely known from the waist straps of hiking backpacks. Furthermore provided is a carry bag 20 which extends from a lower end to an upper end 24. The main section 22 of this bag (we could also call it the center section) of the lower end of the carry bag is connected to the waist strap, for example sewn to it, or it can be detachably connected, for example with the aid of snaps, a zipper, buttons or the like. As a rule it is preferable if the main section 22 of the lower end of the carry bag is permanently connected to the waist strap 10, in particular sewn to it. It is even more preferred if this connection is located in the region of the upper edge 12 of the waist strap 10. By joining the main section 22 of the lower end of the carry bag 20 to the waist strap 10, a first connecting width b1 is defined, as shown in FIG. 2.

Extending from the upper end 24 of the carry bag 20 are two shoulder straps 29, 29' for which the second ends are also connected to the carry bag 20. A length adjustment of the shoulder straps 29, 29' can be provided which, however, is not important to the present invention and is therefore not shown. It is furthermore possible, for example, that the shoulder straps 29, 29' are crossed when in use, wherein it would also be possible that the lower ends of the shoulder straps 29, 29 are connected or can be connected to the waist strap.

Respectively one wing 26, 26' extends on the left and the right side, adjacent to the main section 22 of the lower end of the carry bag 20, wherein the wings 26, 26' can be, but need not be, embodied integrally with the carry bag 20. As shown, it is preferable for the wings 26, 26' to extend "downward" in a state not influenced by outside forces, meaning they extend past the main section 22 of the lower end of the carry bag 20. Each wing 26, 26' is provided with at least one fastening element. For the embodiment shown, respectively two fastening elements are provided, namely a first snap 27*a*, 27*a*' and a second snap 27*b*, 27*b*'. As previously mentioned, other fastening elements such as Velcro elements, hook elements, buttons, eyelets, button holes, zipper halves or the like can also be provided alternatively or in addition to the snaps. For reasons of clarity, only the snaps are shown.

As follows in particular from FIG. 2, the waist strap 10 is provided with at least one counter fastening element for each wing 26, 26'. For the example shown herein, there are two counter fastening elements, namely a first counter snap 17*a*, 17*a*' and a second counter snap 17*b*, 17*b*' (shown with dashed lines). Insofar as the wings 26, 26' contain other or additional fastening elements, corresponding different and/or additional counter fastening elements would have to be provided on the waist strap 10.

For the concrete example shown, the counter fastening elements (counter snaps 17*a*, 17*a*'; 17*b*, 17*b*') respectively are accommodated in pockets 16, 16' that are open on the top, meaning the waist strap 10 is embodied with two layers in the region of the pockets.

At least one additional counter fastening element that is arranged on the carry bag is assigned to each wing 26, 26' which in this case takes the form of an additional counter snap 28, 28'.

As previously mentioned, FIG. 2 shows a first use state in which the wings 26, 26' are not connected to the waist strap 10, and the connecting width between the lower end of the carry bag 20 and the waist strap 10 is defined by the connection between the main section 22 of the lower end of the carry bag 20 and the waist strap 10. The connection width is given the reference b1 in this case. In the first use state, it is preferable if respectively one snap is connected to the counter snap 28, 28' assigned thereto. For the first use state adjustment shown in FIG. 2, this is respectively the first snap 27*a*, 27*b*.

Owing to the fact that each wing 26, 26' is provided with more than one snap, in this case two snaps, the first use state can also be "precisely adjusted," as shown in FIG. 3 where the second snap 27*b*, 27*b*' is respectively connected to its additional counter snap 28, 28'. The same result could be achieved, of course, if more than one additional counter snap would be assigned to each wing 26, 26'. Of course, embodiments allowing more than two of the precise adjustment positions would be possible by providing more snaps or more additional counter snaps.

FIG. 4, finally, shows the second use state in which the snaps 27*a*, 27*a*'; 27*b*, 27*b*' on the wings 26, 26' are connected to the counter snaps 17*a*, 17*a*'; 17*b*, 17*b*' assigned to them, wherein for the embodiment shown the wings 26, 26' are respectively accommodated inside the pockets 16, 16' assigned to them. A second connection width b2 thus results, as shown clearly in FIG. 4, wherein the second connection width b2 is wider than the first connection width b1.

Numerous variations of the above-described embodiment are possible, for example it is not necessary for the counter snaps (or other counter fastening elements) to be accommodated inside pockets. In principle, they could also be located on the front or back of the waist strap.

FIGS. 5 and 6 show an example of a second embodiment of the invention. In contrast to the first embodiment, the waist strap and not the carry bag is provided in this case with additional sections, namely in the form of wings 36, 36'.

Again, there are numerous embodiment variants, in particular relating to the design of the fastening elements and the counter fastening elements. To avoid repetitions, we point to the above statements. For the example of the second embodiment, the wings 36', 36' are fastened on the outside of the carry bag during the second use state, wherein a fastening on the inside would also be possible.

FIGS. 7 and 8 show an example of a third embodiment of the invention. Not provided in this case are wings connected permanently either to the carry bag or the waist strap, but additional elements 42, 42' which do not have to be connected to the carry bag or the waist strap for the first use state (FIG. 7). In the second use state, they are connected to the carry bag as well as the waist strap (FIG. 8). For the exemplary embodiment shown herein, the waist strap also contains pockets (16, 16') into which sections of the additional elements project during the second use state. These pockets can also be used for storing the additional elements (42, 42') during the first use state.

Numerous variants are possible in this case as well, in particular with respect to the embodiment of the fastening elements and the counter fastening elements. To avoid repetitions, we point to the above text. For the third exemplary embodiment shown, the additional elements 42, 42' are fastened on the outside of the carry bag 20 for the second use state, but a fastening on the inside of the carry bag 20 would also be possible. Besides being stored inside pockets, the additional elements 42, 42' can furthermore be attached on the outside or the inside of the waist strap 10.

The same effect can be achieved with all these embodiments, namely that at least two—but also more than two—different connection widths can be adjusted between the carry bag 20 and the waist strap 10.

REFERENCE NUMBER LIST

10 waist strap
10*a* first end
10*b* second end
12 upper edge

14 lower edge
16, 16' pocket
17*a*, 17*a'* first counter snap
17*b*, 17*b'* second counter snap
20 carry bag
22 main section of the lower end of the carry bag
24 upper end of the carry bag
26, 26' wing of the carry bag
27*a*, 27*a'* first snap
27*b*, 27*b'* second snap
28, 28' additional counter snap
29, 29' shoulder strap
36, 36' wing of the waist strap
42, 42' additional elements

The invention claimed is:

1. A baby and small child carrier, comprising:

a waist strap;

a carry bag having a main body that extends from a lower end to an upper end, a main section of the lower end of the main body of the carry bag being connected to the waist strap, so that during a first use state, a first connecting width is obtained between the carry bag and the waist strap; and at least one additional section of the carry bag in the form of a wing extending from the main body of the carry bag, by means of which the main body of the carry bag is connectable to the waist strap adjacent to the main section of the lower end of the main body, wherein the wing includes at least two fastening elements, the waist strap includes at least one counter fastening element, the main body includes at least one additional counter fastening element, the at least two fastening elements match both the counter fastening element and the additional counter fastening element, and are connectable to each of the counter fastening element and the additional counter fastening element, the wing is configured to extend upward when any of the at least two fastening elements is connected to the additional counter fastening element to define the first use state in which the lower end of the main body of the carry bag has the first connecting width, such that a gap exists between the main body of the carry bag and the waist strap, the wing is configured to extend downward when any of the at least two fastening elements is connected to the counter fastening element of the waist strap to define a second use state in which the gap is closed and a second connecting width of the lower portion of the main body of the carry bag to the waist strap is obtained, the second connecting width being greater than the first connecting width, and the wing is placeable into at least two defined positions in the first use state, a first defined position obtained by connecting a first fastening element of the as least two fastening elements to the additional counter fastening element, and a second defined position obtained by connecting a second fastening element of the at least two fastening elements to the additional counter fastening element, the first defined position having a connecting width of the lower portion of the main body of the carry bag to the waist strap different than the second defined position.

2. The baby and small child carrier according to claim 1, wherein the waist strap includes one or more sections with double layers so that a pocket is formed in which the at least one additional section of the carry bag can be accommodated, at least in part.

3. The baby and small child carrier according to claim 2, wherein the waist strap includes at least one counter fastening element inside the pocket.

4. The baby and small child carrier according to claim 1, wherein the main section of the lower end of the carry bag is sewn to the waist strap to be permanently connected to the waist strap.

5. The baby and small child carrier according to claim 1, wherein the at least one additional section of the carry bag includes at least two wings located symmetrically on both sides of the main section of the lower end of the carry bag.

6. The baby and small child carrier according to claim 1, wherein the first and second fastening elements are located below an upper edge of the waist strap when the wing is extended downward to define the second state.

7. The baby and small child carrier according to claim 6, wherein at least one additional section of the carry bag includes two wings located symmetrically on both sides of the main section of the lower end of the carry bag, a first wing of the two wings including the first and second fastening elements, and a second wing of the two wings including third and fourth fastening elements, wherein a width between the first and third fastening elements is less than a width of the lower end of the main body of the carry bag, and a width between the second and fourth fastening elements is greater than the width of the lower end of the main body of the carry bag.

8. The baby and small child carrier according to claim 1, wherein the additional counter fastening element is located on an outside surface of the main body of the carry bag.

9. A baby and small child carrier, comprising:

a waist strap;

a carry bag having a main body that extends from a lower end to an upper end, a main section of the lower end of the main body of the carry bag being connected to the waist strap, so that during a first use state, a first connecting width is obtained between the carry bag and the waist strap; and at least one additional section of the carry bag in the form of a wing extending from the main body of the carry bag, by means of which the main body of the carry bag is connectable to the waist strap adjacent to the main section of the lower end of the main body, wherein the wing includes at least one fastening element, the waist strap includes at least one counter fastening element, the main body includes at least two additional counter fastening elements, the fastening element matches all of the counter fastening element and the at least two additional counter fastening elements, and is connectable to each of the counter fastening element and the at least two additional counter fastening elements, the wing is configured to extend upward when the fastening element is connected to any of the at least two the additional counter fastening elements to define the first use state in which the lower end of the main body of the carry bag has the first connecting width, such that a gap exists between the main body of the carry bag and the waist strap, and the wing is configured to extend downward when the fastening element is connected to the counter fastening element of the waist strap to define a second use state in which the gap is closed and a second connecting width of the lower portion of the main body of the carry bag to the waist strap is obtained, the second connecting width being greater than the first connecting width, wherein the wing is placeable into at least two defined positions in the first use state, a first defined position obtained by connecting the fastening element to a first additional counter fastening element of the at least two additional counter fastening elements, and a second defined position obtained by connecting the fastening element to a second additional counter fastening element of the at least two additional counter fastening elements, the first defined position having a connecting width of the lower portion of the main body of the carry bag to the waist strap different than the second defined position.

* * * * *